US005445229A

United States Patent [19]

Delima

[11] Patent Number: 5,445,229

[45] Date of Patent: Aug. 29, 1995

[54] METHOD AND APPARATUS FOR DRILLING, CRACKING, AND WITHDRAWING EARTH CORES

[76] Inventor: Robert L. Delima, P.O. Box 117, Kurtistown, Hi. 96760

[21] Appl. No.: 304,776

[22] Filed: Sep. 12, 1994

[51] Int. Cl.[6] ..... E21B 7/26; E21B 25/10

[52] U.S. Cl. ..... 175/20; 175/249

[58] Field of Search ..... 175/246, 248, 249, 253, 175/255, 251, 20; 166/99, 301; 405/232

[56] References Cited

U.S. PATENT DOCUMENTS

| | | | |
|---|---|---|---|
| 331,319 | 12/1885 | Parker | 294/88 |
| 1,252,555 | 1/1918 | Dodds | 294/88 |
| 1,553,540 | 9/1925 | Kurtz | 294/88 |
| 1,568,808 | 1/1926 | Davison | 294/88 |
| 1,571,332 | 2/1926 | Herminghausen | 294/88 |
| 1,730,705 | 10/1929 | Wild | 175/285 |
| 1,986,095 | 1/1935 | Allard | 175/285 |
| 2,019,176 | 10/1935 | Dodds | 175/253 |
| 2,161,582 | 6/1939 | Mackenzie et al. | 175/254 |
| 2,315,590 | 4/1943 | Cantrell, Jr. | 175/253 |
| 2,499,508 | 3/1950 | Karhu | 175/285 |
| 2,604,709 | 7/1952 | Sandona | 175/285 |
| 2,828,943 | 4/1958 | Ricouard | 175/285 |
| 2,879,974 | 3/1959 | Jourdain | 175/285 |
| 3,328,068 | 11/1965 | Robinson | 175/253 |
| 4,705,314 | 11/1987 | Moore | 294/115 |
| 5,146,999 | 9/1992 | Wiser et al. | 175/254 |
| 5,209,536 | 5/1993 | Rogers | 294/88 |
| 5,228,735 | 7/1993 | Morrow | 294/88 |

*Primary Examiner*—Ramon S. Britts
*Assistant Examiner*—Frank S. Tsay
*Attorney, Agent, or Firm*—Seth M. Reiss

[57] ABSTRACT

A method and apparatus for drilling, cracking, and withdrawing solid each cores, the method commencing with coring the earth using a conventional rotary core drill (20). The core drill is withdrawn to leave an attached earth core (26) and a drilled core groove (24). A hydraulically powered core cracker assembly (40) sized to fit the drilled groove is screwed into the groove. A ram drawer (44) built into the cracker assembly is activated to break off the earth core at its base. The cracker assembly is then withdrawn and a hydraulically powered core grabber/remover assembly (70) sized to fit the drilled groove is screwed into the groove, activated to engage the earth core, and hoisted to remove the earth core from the drill hole. Preferred embodiments of the core cracker and core grabber/remover assemblies are described.

17 Claims, 7 Drawing Sheets

METHOD AND APPARATUS FOR DRILLING, CRACKING, AND WITHDRAWING EARTH CORES

BACKGROUND

1. Field of Invention

The present invention relates to annular core or barrel drilling. More particularly, this invention describes a method and apparatus for drilling, cracking, and withdrawing solid earth and rock cores.

2. Description of the Prior Art

Rotary core or barrel drilling is a well known and understood method of drilling holes by coring the earth. It involves the use of an annular drill bit, head or core barrel attached to conventional drill machinery which rotates and pushes the head or barrel downward into earth and rock. These drills core the ground such that, when the core barrel is withdrawn, barrel shaped core material is left within the bore hole. This core material is awkward and cumbersome to remove, particularly in the case of wide diameter cores. When drilling dense earth or rock, the core is left attached to the ground at its base requiring that it be freed prior to removal.

Apparatus and methods for grabbing and withdrawing material from well drill holes are well know and available in a variety of forms. Many spring loaded fishing tools and grappling devices have been described which are lowered into, or mounted within, drill stems and casings. These tools and devices, such as the apparatus described in U.S. Pat. No. 1,553,540 issued to Kurtz and U.S. Pat. No. 1,571,332 issued to Herminghausen, are suitable for extracting small articles and obstacles encountered or lost while drilling narrow-diameter deep well holes.

Devices for removing core materials from inside a drill casing, for purposes of sampling the core materials or otherwise, have also been described. U.S. Pat. No. 331,319 issued to Parker and U.S. Pat. No. 1,252,555 to Dodds describe apparatus which scoop or grapple core material while functioning from within the drill stem or casing.

All the above described apparatus and devices rely upon the drill stem or casing remaining in the drill hole for their operation. These devices are appropriate for use in narrow-diameter deep drill holes but may not be suitable or efficient for removing large diameter solid earth or rock cores. Such devices may be incapable of freeing solid earth and rock cores left attached to the ground at their base.

Large-diameter, shallow earth core drilling is commonly employed for digging dry wells, holes for building foundations, roadways and other infrastructure. A primary object of the present invention is to provide a means to free and remove solid cores left after barrel drilling, particularly in the case of wide-diameter cores composed of dense earth and rock material.

U.S. Pat. No. 1,730,705, issued to Wild, describes an apparatus having a plurality of opposed shovels for removing solid or loose core material. Wild's device is lowered into drilled core grooves after removal of the barrel drill. Relying substantially on gravity and mechanical lifting means, the forces available to break up and lift core material are limited. A further purpose of the present invention is to provide a method for removing large diameter solid earth or rock cores when great force is required in order to free and secure the core material for its withdrawal from the drill hole.

SUMMARY, OBJECTS AND ADVANTAGES OF THE INVENTION

These and other objects are accomplished in the present invention, a method and apparatus for drilling, cracking, and withdrawing earth and rock cores. According to the method of the this invention, a earth core is drilled using a conventional rotating core or barrel drill. The drill is withdrawn and a hydraulically powered core cracker is introduced into the core groove. The core cracker is activated to break the drilled core material off at its base. The cracker is then withdrawn and a hydraulically powered core grabber/remover is inserted into the drilled groove, closed around the drilled core, and is hoisted from the hole carrying with it the now free solid core material.

The core cracker and core grabber/remover are each designed for easy mounting on conventional drill machinery. Each have annular components sized to approximate the barrel drill head so that they fit within the core groove and snugly around the drilled earth core. Each are equipped with hydraulic powered components.

In the case of the core cracker, hydraulically powered pistons press a sliding ram drawer laterally outward against the earthen wall. This creates a counterbalancing lateral force of the cracker assembly on the drilled core which breaks the solid earth core off at the core base.

In the case of the core grabber, hydraulically powered pistons cause hinged jaws to open and close around the core material enabling the material to be lifted and deposited outside the drill hole.

Each apparatus of the present invention is dedicated to individual cracking and grabbing functions, and neither depends or relies upon the presence of a drill stem or casing for its placement or operation. This, together with the great forces generated by hydraulic components, enable the apparatus to break off and remove very large cores and cores composed of dense and hard materials. Moreover, the apparatus of the present invention allow core removal to proceed quickly and at low cost.

Accordingly, the method and apparatus of the present invention facilitates over the prior art the breaking and removal of large diameter drilled earth cores as well as of cores composed of dense earth and rock in a manner that is cost-effective as well as efficient.

Further objects and advantages of the present invention will become apparent from consideration of the ensuing description and drawings.

BRIEF DESCRIPTION OF THE DRAWINGS

METHOD

FIG. 1 is a method schematic showing the three steps of (1) drilling, (2) cracking, and (3) grabbing and removing drilled earth cores;

HYDRAULIC OPERATION

Figure 2:
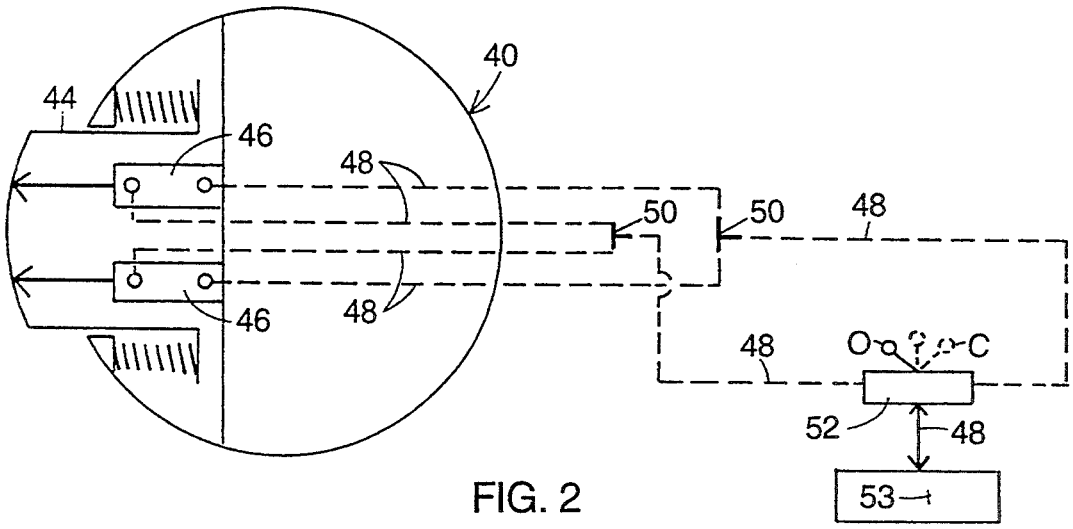
Figure 3:
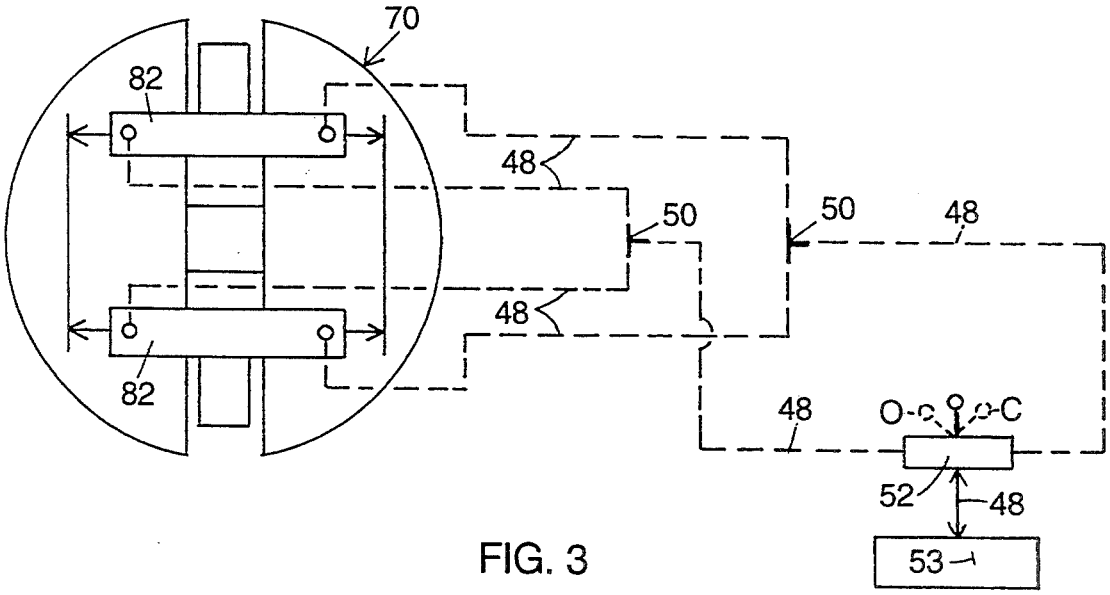

FIG. 2 is a hydraulic schematic of the operation of the core cracker;

FIG. 3 is a hydraulic schematic of the operation of the core grabber/remover;

CORE CRACKER

Figure 4:
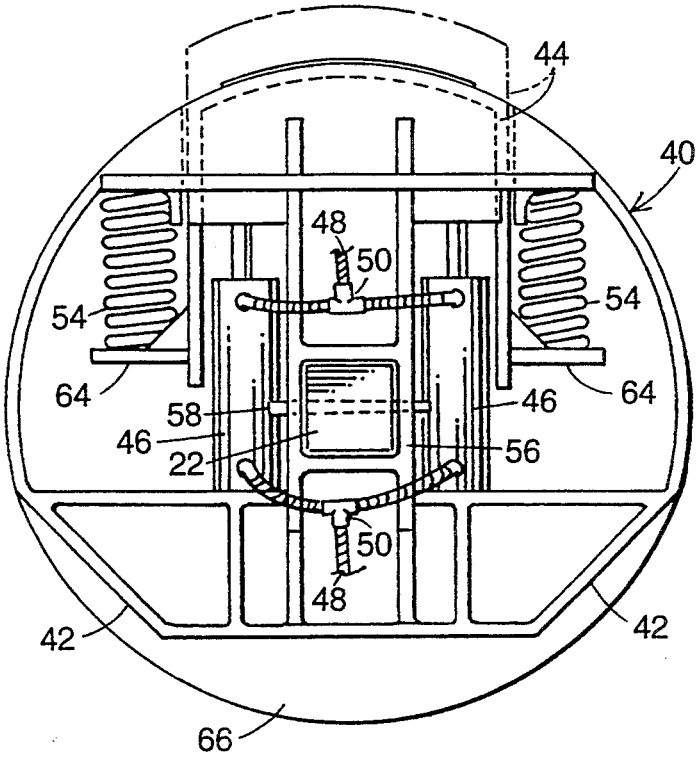
Figure 5:
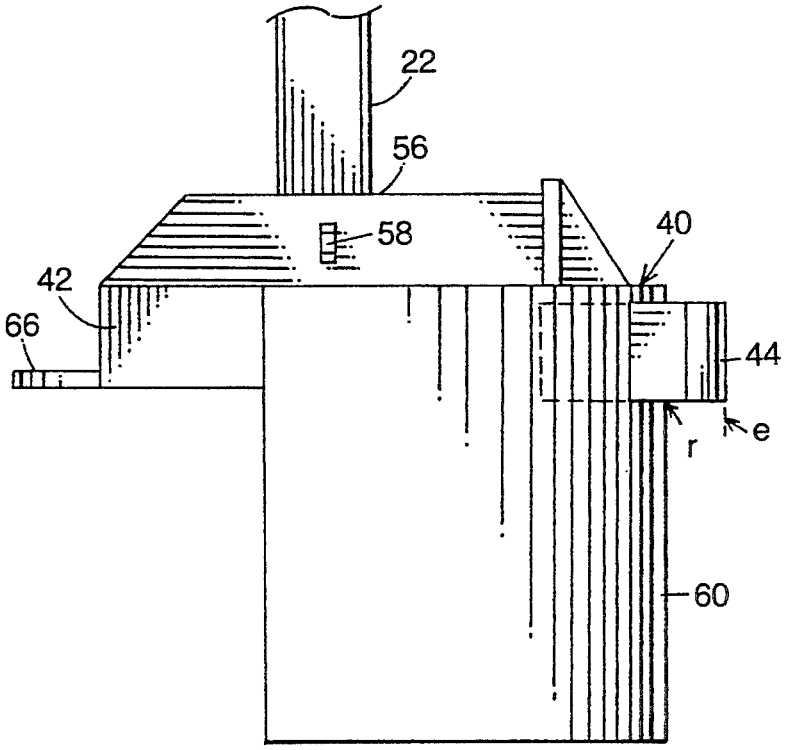
Figure 6:
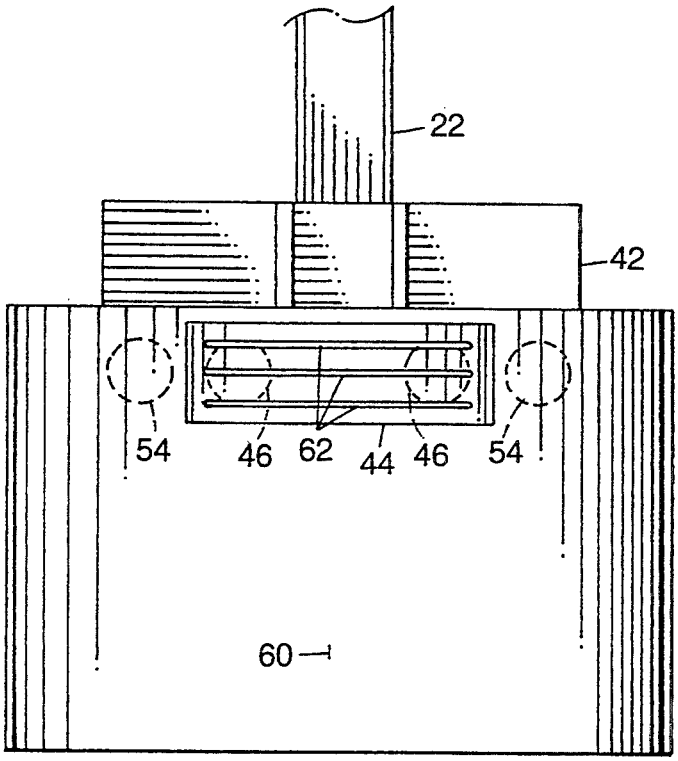
Figure 7:
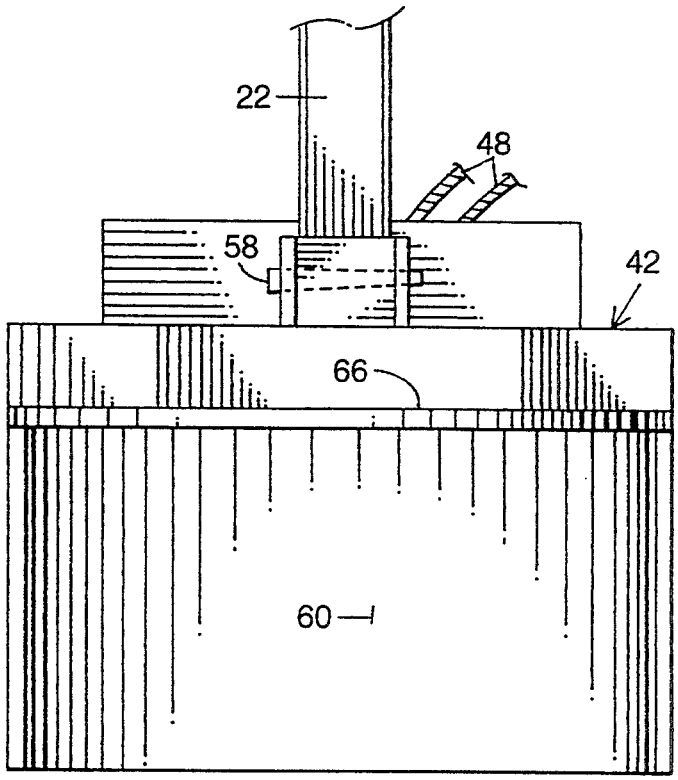
Figure 8:
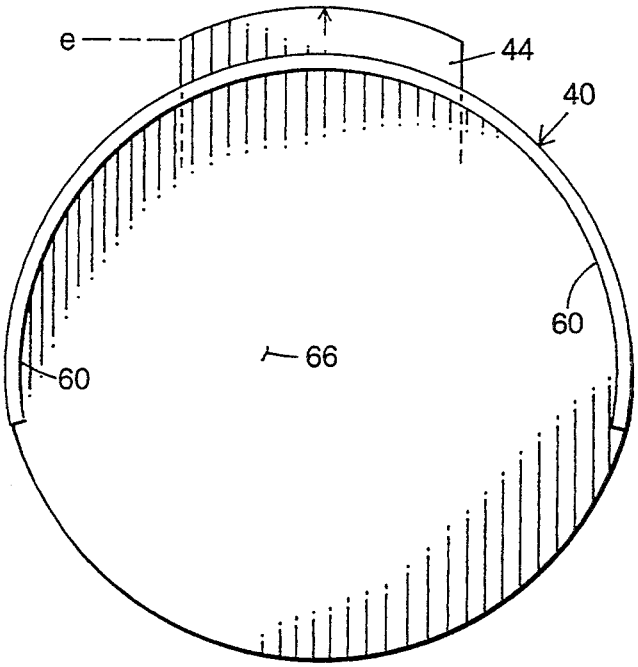

FIG. 4 is a top plan view of the core cracker;

FIG. 5 is a side elevational view thereof, the other side being a mirror image;

FIG. 6 is a front elevational view thereof;

FIG. 7 is a rear elevational view thereof showing the drawer;

FIG. 8 is a bottom plan view of the core cracker;

CORE GRABBER/REMOVER

Figure 9:
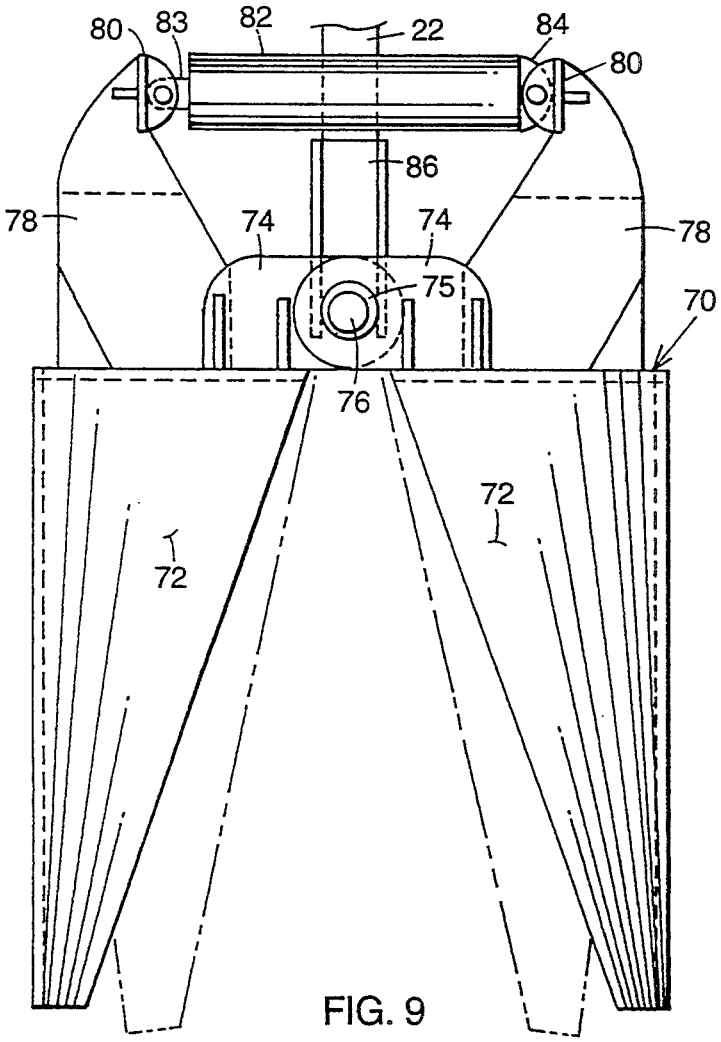
Figure 10:
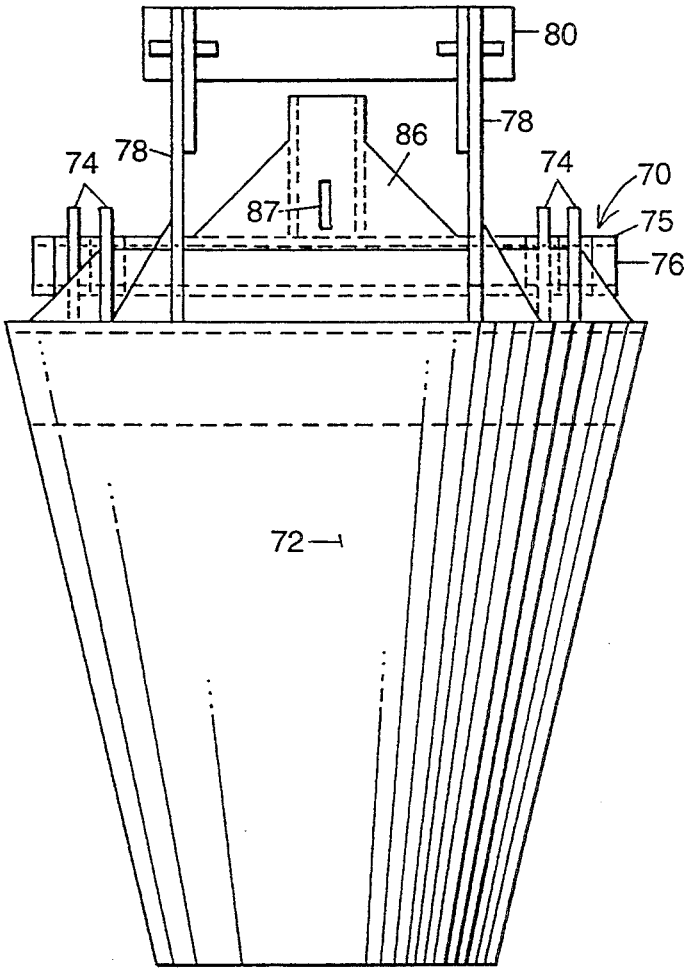
Figure 11:
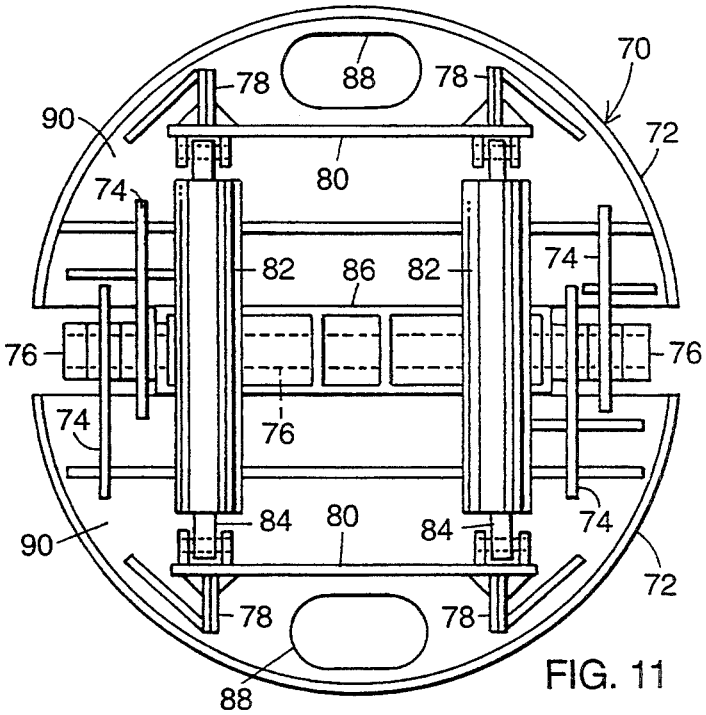
Figure 12:
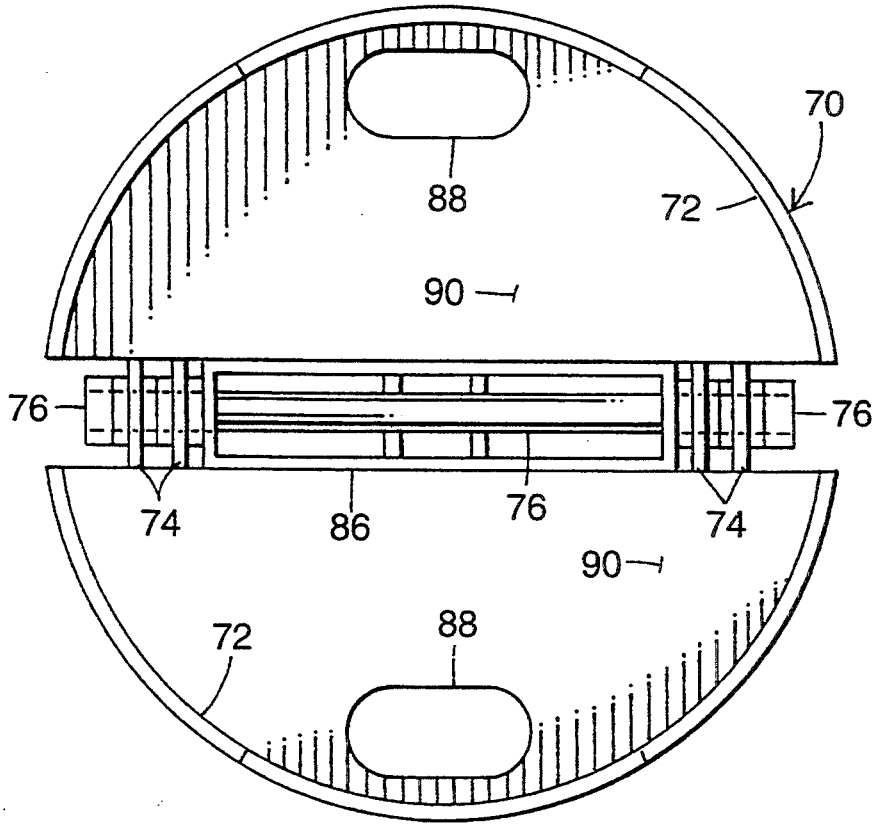

FIG. 9 is a side elevational view of the core grabber/-remover, the other side being a mirror image;

FIG. 10 is a front elevational view thereof, the rear view being a mirror image;

FIG. 11 is a top plan view thereof;

FIG. 12 is a bottom plan view of the core grabber/-remover.

| REFERENCE NUMBERS IN DRAWINGS | |
|---|---|
| 20 - Core Drill | 22 - Kelley Bar |
| 24 - Drilled Core Groove | 26 - Earth Core Attached |
| 26a - Core Cracked Off | 28 - Separation Line |
| 40 - Core Cracker Assembly | 42 - Core Cracker Body |
| 44 - Ram Drawer | 46 - Hydraulic Piston |
| 48 - Hydraulic Line | 50 - Hydraulic Tee |
| 52 - Hydraulic Control | 53 - Hydraulic Power Source |
| 54 - Drawer Return Spring | 56 - Kelley Bar Receiver |
| 58 - Locking Pin | 60 - Scoop Wall |
| 62 - Ram Drawer Ribs | 64 - Spring Retainer Wall |
| 66 - Base Plate | 70 - Core Grabber Assembly |
| 72 - Grabber Jaws | 74 - Pivot Support |
| 75 - Pivot Support Eye | 76 - Pivot Shaft |
| 78 - Grabber Arm | 80 - Piston Receiving Plate |
| 82 - Double Ended Piston | 83 - Piston Shaft |
| 84 - Piston Connector | 86 - Kelley Bar Receiv. Box |
| 87 - Pin Slot | 88 - Window |
| 90 - Half Plate | |

DETAILED DESCRIPTION OF THE PREFERRED EMBODIMENTS

FIG. 1—Method.

The three stages of the method of present invention, drilling, cracking, and grabbing/removing drilled earth cores, are illustrated in FIG. 1.

Figure 1C:
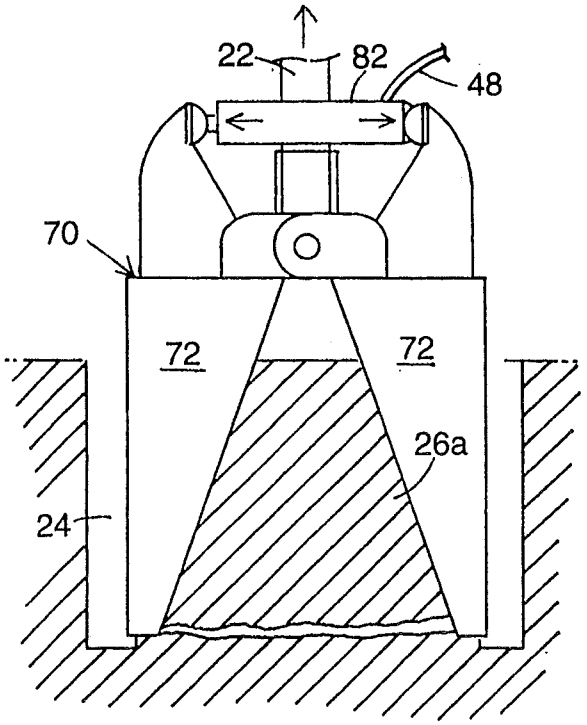
Figure 1B:
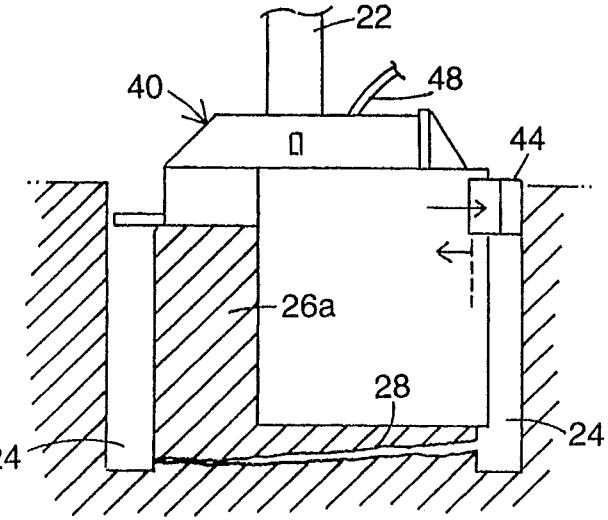
Figure 1A:
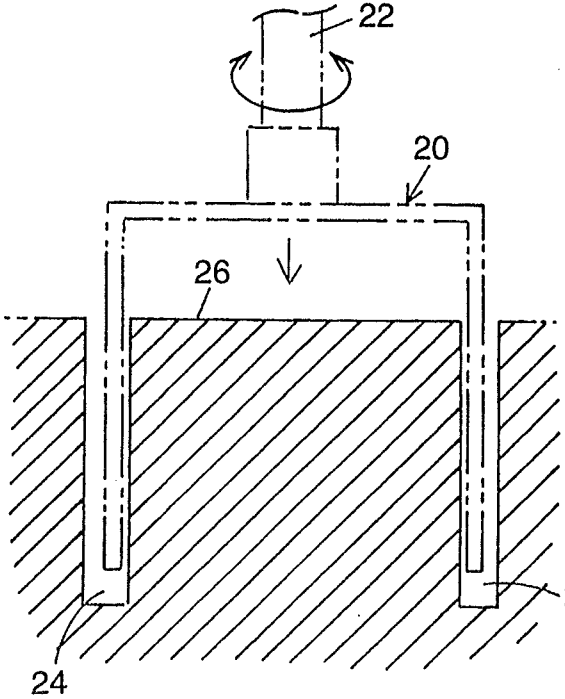

FIG. 1A depicts the drilling step, showing a conventional annular core or barrell drill 20, attached to a Kelley Bar 22 (capable of rotating while being manipulated up and down) which, in turn, is attached to conventional drilling machinery (not shown). Kelley Bar 22 is shown rotating and moving drill 20 downward creating a tube-shaped core groove 24. When groove 24 is fully drilled, drill 20 is withdrawn leaving an earth core 26 which remains adhered to the ground at its base.

FIG. 1B illustrates the core cracking stage of the method of the present invention utilizing the core cracker apparatus of the present invention. Core drill 20 is removed from Kelley Bar 22 and a core cracker assembly 40 is attached in its place. Cracker assembly 40 is lowered and screwed into drilled groove 24. One or more hydraulic lines 48 supply hydraulic power to pistons (shown in FIGS. 2 and 4) located within assembly 40. When activated, the hydraulic powered pistons press a ram drawer 44 laterally outward against the outside wall of groove 24. Counterbalancing forces press cracker assembly 40 against attached core 26. These forces cause core 26 to crack off along a separation line 28, leaving an unattached core 26a.

The third stage of the method of the present invention, which utilizes the core grabber/remover apparatus of the present invention, is illustrated in FIG. 1C. Core cracker assembly 40 is removed from Kelley Bar 22 and a core grabber/remover assembly 70 attached in its place. Grabber assembly 70 is lowered and screwed into groove 24. Hydraulic lines 48 supply hydraulic power to one or more double ended hydraulic pistons 82 causing a pair of opposed cylindrically-shaped jaws 72 of grabber assembly 70 to close around unattached drill core 26a. Grabber assembly 70 is then hoisted by means of Kelley Bar 22, and drill core **26*a*** is withdrawn and may be deposited outside the cored hole.

FIG. 2 and 3—Hydraulic operation of the core cracker and core grabber/remover apparatus.

Schematics showing in detail the hydraulic operation of preferred embodiments of the core cracker and core grabber/remover apparatus of the present invention are illustrated in FIGS. 2 and 3, respectively.

FIG. 2 shows a power source 53 supplying hydraulic power to core cracker assembly 40 through hydraulic lines 48. A single line 48 is the conduit of hydraulic power from source 53 to a hydraulic control 52. Thereafter a plurality of hydraulic lines 48, and a plurality of hydraulic tees 50 located along lines 48, feed hydraulic power from control 52 to multiple locations on one or more hydraulic pistons 46 located within cracker assembly 40.

When in an open position o, hydraulic control 52 allows hydraulic power to flow to pistons 46 causing pistons 46 to press outward on ram drawer 44. When control 52 is in a closed position c, the flow of hydraulic power is shut off and pistons 46 are allowed to retract inward towards the center of cracker assembly 40 and thereby to assume their initial configuration.

An analogous hydraulic schematic showing the operation of the core grabber/remover apparatus in found in FIG. 3. Power source 53 supplies hydraulic power to core grabber/remover assembly 70 through hydraulic lines 48. Hydraulic control 52 controls the flow of hydraulic power through hydraulic lines 48 and hydraulic tees 50 to doubled ended pistons 82 housed in grabber assembly 70. When in open position o, hydraulic control 52 routes hydraulic power to pistons 82 causing them to extend bilaterally outward. When in closed position c, control 52 cuts off hydraulic power allowing pistons 82 to retract towards the center of core grabber assembly 70.

Power source 53 may be available on the drill machinery (not shown) being used to power Kelley Bar 22, or it may be an independent source of portable hydraulic power. Forces required to crack drilled earth core 26 are often greater than those required to grab and lift freed earth core **26*a*. More than one hydraulic power source 53** may be combined to achieve the great forces required to break up wide-diameter solid earth and rock drilled cores.

Power source 53 may be located on the drill machinery or anywhere in vicinity of the drilled core. Whereas only one hydraulic control 52 is illustrated in FIGS. 2 and 3, more than one control 52 may be placed along hydraulic lines 48 between power source 53 and core cracker assembly 40 or core grabber assembly 70, for ease of use. Also, control 52 can be mounted in the cab of the drill machinery (not shown), on the core cracker or grabber/remover apparatus, or at any intermediate point, as may be required by or convenient to the circumstances.

FIGS. 4–8 Core cracker apparatus.

Details of one preferred embodiment of the core cracker apparatus of the present invention are illustrated in FIGS. 4 through 8.

Referring first to FIG. 4, a top plan view of core cracker assembly 40, assembly 40 has a cracker body 42 the floor of which is formed by a circular base plate 66. Base plate 66 is sized to approximate the diameter of core drill 20 (shown in FIG. 1C). Ram drawer 44 is built into and shown extending from the front of cracker body 42.

Two hydraulic pistons 46 are mounted within cracker body 42, one on each side of a Kelley Bar receiver 56. Receiver 56 is centrally located within cracker body 42. Kelley Bar 22 (shown in FIG. 1B) is lowered into Kelly Bar receiver 56 and secured to body 42 by means of a locking pin 58.

Hydraulic lines 48 carry hydraulic fluid to pistons 46 via hydraulic tees 50. Two helical compression drawer return springs 54 are mounted within cracker body 42 parallel to and substantially alongside pistons 46. One end of each return spring 54 is lodged against an inside forward wall of cracker body 42. The opposite end of each return string 54 is restrained by a return spring retainer wall 64. Spring retainer wall 64 is slidably arranged within cracker body 42 and is structurally continuous with ram drawer 44.

FIG. 5 is a side elevational view of core cracker assembly 40 (the opposite side being a mirror image thereof and identical thereto). A half-cylinder scoop wall 60 extends downward from cracker body 42 and forms a part of the front thereof. Comprising the floor of cracker body 42 is base plate 66. Ram drawer 44 is built into cracker body 42, just above base plate 66, and can be extended outward from the front of cracker body 42 being the front top portion of scoop wall 60.

Cracker assembly 40 is secured to conventional drill machinery (not shown) via Kelley Bar 22, Kelley Bar receiver 56, and locking pin 58.

When hydraulically empowered, ram drawer 44 is pushed outward to a position e relative to scoop wall 60. When hydraulic power is cut off, return springs 54 (shown in FIG. 4) return ram drawer 44 to a fully retracted position r within cracker body 42 flush with the front face of scoop wall 60.

FIGS. 6 and 7 are front and rear elevations, respectively, of core cracker assembly 40. FIG. 6 shows the continuous convex outside front of cracker body 42 and scoop wall 60, with Kelley Bar 22 extending upwards from cracker body 42. Ram drawer 44, having a plurality of horizontally oriented ribs 62, is built into the front top aspect of scoop wall 60.

FIG. 7 illustrates cracker body 42, base plate 66, and the concave inside of scoop wall 60. As before, the assembly is secured from above by Kelley Bar 22 and locking pin 58 and hydraulic lines 48 are shown extending out from body FIG. 8, a bottom plan view of cracker assembly 40, shows base plate 66 surrounded, in part, by scoop wall 60, and the bottom of ram drawer 44 in extended position e.

Cracker body 42 houses the moving components of cracker assembly 40, including pistons 46, ram drawer 44, return springs retainer wall 64, and return springs 54. Base plate 66 reinforces cracker assembly 40 while providing a floor to cracker body 42 and the components therein. Ram drawer 44 is slidably mounted within cracker body 42 and is structural continuous with return springs retainer wall 64. Scoop wall 60 approximates a section of core drill 20 and is sized to match drilled groove 24.

Whereas body 42 is described herein as having the specific configuration illustrated, it will be appreciated that the specific configuration or structure of body 42, and the arrangement of moving components therein, can be varied without departing from the principles and concept of the present invention. Similarly, a plurality of drawers 44 may be substituted for one ram drawer 44 described above, one or more than two pistons 46 may be substituted for the two pistons 46 shown the illustrated embodiment, and any return means may be employed in place of the two helical compression springs 54.

It will also be appreciated that a variety of hydraulically powered components capable of causing lateral forces between scoop wall 60 and drilled core 26 can be substituted for ram drawer 44 without departing from the concept of the present invention and without compromising its functionality.

FIGS. 9–12 Core grabber/remover apparatus.

Details of one preferred embodiment of the core grabber/remover apparatus of the present invention are shown in FIGS. 9 through 12.

FIG. 9 is a side elevational view of core grabber/-remover assembly 70 (the opposite side being a mirror image thereof and identical thereto). Opposed grabber jaws 72 are hung from and secured to grabber arms 78. Two grabber arms 78 support each grabber jaw 72. (Two mirror image grabber arms 78 are not visible in this figure).

The jaw 72/arm 78 assemblies are hingeably joined to one another by means of a plurality of pivot supports 74 and a pivot shaft 76. One pivot support 74 extends upward and inward from each top inside section of jaw 72. Each pivot support 74 has an eye 75 sized to receive pivot shaft 76. Eyes 75 of pivot supports 74 are placed to coincide and accept pivot shaft 76.

A Kelley Bar receiving box 86 for receiving Kelley Bar 22 is centrally located within grabber assembly 70 between grabber arms 78 and pivot supports 74. The middle portion of pivot shaft 76 is firmly affixed to the base of receiving box 86 in a T-shaped arrangement.

When inserted through pivot support eyes 75, pivot shaft 76 serves to join grabber arm 78/grabber jaws 72 assemblies to one another and to receiving box 86. Pivot shaft 76 also functions to allow grabber arm 78/grabber jaw 72 assemblies to rotate about shaft 76 relative to one another and relative to Kelley Bar 22.

Double ended hydraulic piston 82 is mounted above pivot supports 74 spanning the distance between the top ends of grabber arms 78. A piston shaft 83 extends outward from one side of piston 82, while a piston connector 84 secures each end of piston 82 and to a piston receiving plate 82. Piston receiving plates 82 are mounted on the inside top faces of grabber arms 78. Piston 82 communicates with grabber arm 78 through piston connectors 84 and receiving plates 82.

Although only one piston 82 can be seen in FIG. 9, another piston 82 is mounted on the other (mirror image) side of grabber assembly 70.

A front elevational view of core grabber assembly 70 is shown in FIG. 10 (the opposite side being a mirror image thereof and identical thereto). Two grabber arms 78 and two pivot supports 74 are mounted on and extend upwards from the top of grabber jaw 72. Two additional pivot supports 74 visible in FIG. 10 arise from the opposed grabber jaw 72 (not visible in this figure).

Piston receiving plate 82 joins the top inside faces of grabber arms 78 and receives piston connectors 84 of double ended pistons 82 (also not visible in this figure).

Pivot shaft 76, lying just above and running the width of jaw 72, is secured to the bottom of Kelley Bar receiving box 86 while traversing and intersecting pivot supports 74. Visible in this figure is a pin slot 87 formed in receiving box 86 intended to receive locking pin 58 and secure grabber assembly 70 to Kelley Bar 22.

A top plan view of grabber/remover assembly 70 is shown in FIG. 11. Kelley Bar receiving box 86 is located in the center of grabber assembly 70, with pivot shaft 76 extending laterally therefrom. Grabber jaws 72 form the outside cylindrical edge of assembly 70. Extending upwards from jaws 72 are grabber arms 78 and pivot supports 74. A semi-circular half plate 90 comprises the ceiling of each grabber jaw 72 and is the base from which pivot supports 74 and grabber arms 78 arise. A window 88 in each half plate 90 permits viewing of the drilled core from above grabber assembly 70. Pivot shaft 76 joins pivot supports 74 to each other and to Kelley Bar receiving box 86.

Two double ended hydraulic pistons 82 straddle Kelley Bar receiving box 86. Each end of each piston 82 has piston connector 84 secured to and communicating with ram receiving plates 82 mounted on the inside face of grabber arms 78.

FIG. 12 illustrates the underside of grabber assembly 70. Grabber jaws 72 are tapered half-cylinders sized to fit drilled groove 24. The tops of grabber jaws 72 are joined to base plates 90. Inhering in each half plate 90 is window 88. Lying between half plates 90 is the bottom of pivot shaft 76 and the ends of pivot supports 74. Pivot shaft 76, affixed and forming the base of Kelley Bar receiving box 86, traverses and intersects pivot supports 74.

Grabber jaws 72 of the preferred embodiment illustrated herein are half cylinders, wide on top and tapering towards the bottom. Though always sized to fit the drilled core, grabber jaws 72 may take different forms. Instead of two opposed grabber jaws 72, three or more jaws can be employed and grabber jaws 72 can be equipped with teeth or aspects on their interior surfaces to facilitate grabbing and lifting earth core **26*a***.

It will also be appreciated that one or more than two pistons 82, singled ended pistons, and alternative hydraulic ram components can be substituted for the two double ended piston ram arrangement described in the preferred embodiment. Moreover, other configurations of grabber arm 78 and the illustrated hinge arrangement can be employed in this core grabber/remover apparatus without departing from the concept or spirit of the present invention.

OPERATION OF PREFERRED EMBODIMENTS

The operation of core cracker assembly 40 is described with reference to FIGS. 1, 2, and 4 through 8. Cracker assembly 40 is mounted to Kelley Bar 22 via Kelley Bar receiver 56 and locking pin 58. Hydraulic lines 48 are connected to hydraulic pistons 46 mounted within cracker body 42.

Scoop wall 60 of cracker assembly 40, sized to fit around drilled core 26, is rotated and pushed downward into drilled groove 24 by means of Kelley Bar 22 and a conventional drill machine (not shown).

Once cracker assembly 40 has been fully deployed into drilled groove 24, hydraulic control 52 is opened. The opening of control 52 causes hydraulic power to flow from power source 53 through hydraulic lines 48 and hydraulic tees 50 to hydraulic pistons 46. The supply of hydraulic power to pistons 46 causes pistons 46 to push outward on ram drawer 44 which, in turn, causing ram drawer 44 to press outward against the outside earthen wall of drilled groove 24.

The force of ram drawer 44 against the wall of drilled groove 24 creates a counterbalancing force of scoop wall 60 on attached earth core 26. This counterbalancing force causes the base of attached earth core 26 to break off along separation line 28.

Once earth core 26 has been cracked free, hydraulic control 52 is closed causes hydraulic pressure through lines 48 to be shut off. Hydraulic pressure having been released, drawer return springs 54 and return spring retaining wall 64 retract drawer 44 and pistons 46 to their original configuration. Cracker assembly 40 is then hoisted leaving behind freed earth core **26*a***.

The operation of core grabber/remover assembly 70 is described with reference to FIGS. 1, 3, and 9 through 12. Kelley Bar 22 is inserted in Kelley Bar receiving box 86 and secured with locking pin 58. Hydraulic lines 48 are connected to double ended hydraulic pistons 82 lying between grabber arms 78.

Grabber assembly 70, sized to fit snugly around drilled core **26*a*, is then screwed into drilled groove 24 using Kelley Bar 22** attached to and powered by a conventional drill machine (not shown).

Once fully installed around earth core **26*a*, hydraulic control 52 is opened allowing hydraulic power to flow from power source 53 through hydraulic lines 48 and tees 50 to double ended pistons 82. Increased hydraulic pressure causes expansion of piston shafts 83. Each end of piston 82 presses outward against the top of grabber arms 78 via piston connectors 84 and receiving plates 82. Each grabber arm 78/grabber jaw 72 assembly is thus rotated around pivot shaft 76 in opposite directions, causing grabber jaws 72 to close around drilled earth core 26*a***.

After earth core **26*a* is firmly secured between grabber jaws 72, assembly 70 is hoisted out of groove 24 by means of Kelley Bar 22 and the conventional drill rig (not shown). Kelley Bar 22 is then manipulated laterally and earth core 26*a* released, by closure of hydraulic control 52, from grabber jaws 72 onto the earth's surface. After hydraulic pressure has been released, double ended piston 72 retracts grabber arms 78/jaws 72** assemblies to their initial open jaw configuration.

SUMMARY SCOPE

Accordingly, it will be readily appreciated that the method and apparatus of the present invention promote the removal of solid earth cores, after drilling using conventional core drill technology, particularly in cases where the drill cores are of large diameter and densely composed material.

The apparatus of the present invention do not depend upon the presence of a drill stem or casing for their use. Because the core cracker and grabber/remover apparatus are sized to fit the drilled earth cores, having diameters which match the diameter of the barrel drill used to core the earth, they may be used after the drill bit, casing, or stem has been removed and irrespective of the continued availability of the bit, casing, or stem.

Since the drill bit, stem, or casing used to core the earth need not accommodate components designed to accomplish cracking, grabbing, and hoisting functions, the bit, stem, or casing can be fully dedicated to the drilling function. This permits greater flexibility in terms of choice of drill bits and greater drilling efficiencies are achievable.

Likewise, because each apparatus of the present invention is designed to accomplish a single function, freeing solid earth cores in the case of the core cracker, and hoisting and removing solid earth cores in the case of the core grabber/remover, each apparatus can accomplish its respective function efficiently and at low cost.

The great forces required for cracking and hoisting large diameter solid earth and rock cores are not normally attainable using mechanically powered machinery. Large diameter cored earth holes useful for digging dry wells, building foundations, and foundations for a variety of infrastructure, require heavy, dedicated apparatus capable of exerting and withstanding substantial forces. The hydraulically powered apparatus of the present invention are capable of exerting and withstanding the great forces needed to break and extract rock cores of considerable diameter.

Although the description above contains many specifications, these should not be construed to as limiting the scope of the invention but merely as providing illustrations of some of the presently preferred embodiments of this invention. For example, in the case of soft earth cores, use of the core grabber/remover apparatus after drilling, without the intermediate cracking step, would be logical and most efficient.

Thus the scope of the invention should be determined by the appended claims and their legal equivalents, rather than by the examples given.

The embodiments of the invention which an exclusive property or privilege is claimed are defined as follows:

1. A method for drilling and withdrawing earth cores, comprising the steps of:

(a) coring the earth using a conventional rotary core drill;

(b) withdrawing said core drill to leave an earth core within a core groove;

(c) screwing into said core groove a hydraulic powered grabber/remover apparatus sized to fit said core groove;

(d) activating said grabber/remover apparatus to engage said earth core;

(d) hoisting said grabber/remover apparatus to remove said earth core and leaving a core hole.

2. A method for drilling, cracking and withdrawing solid earth cores, comprising the steps of:

(a) coring the earth using a conventional rotary core drill;

(b) withdrawing said core drill to leave an attached earth core within a core groove;

(c) screwing into said core groove a hydraulic powered cracker apparatus sized to fit said core groove;

(d) activating said cracker apparatus to crack free said attached earth core;

(e) withdrawing said cracker apparatus to leave an unattached earth core within said core groove;

(f) screwing into said core groove a hydraulic powered grabber/remover apparatus sized to fit said core groove;

(g) activating said grabber/remover apparatus to engage said earth core.

(h) hoisting said grabber/remover apparatus to remove said earth core and leaving a core hole.

3. An apparatus for cracking solid earth cores comprising:

(a) a cracker body sized to be screwed into a drill groove made by a conventional rotary core drill;

(b) a ram means built into the top portion of said cracker body and extendable therefrom to produce a lateral force sufficient to separate said earth core from the ground.

4. An apparatus for cracking solid earth cores according to claim 3 wherein said ram means is hydraulically powered.

5. An apparatus for cracking solid earth cores according to claim 3 wherein said ram means is a hydraulically powered piston/ram drawer combination.

6. An apparatus for cracking solid earth cores according to claim 3, further comprising a Kelley Bar attached to a conventional drilling machine, whereby said cracker body is detachably secured to the opposing end of said Kelley Bar, and whereby said drilling machine is used to screw down and hoist up said cracker body.

7. An apparatus for cracking solid earth cores according to claim 3 wherein said cracker body further comprises:

(a) a top compartment for stowage of said ram means;

(b) a base configured to encircle a portion of the circumference of said earth core.

8. An apparatus for cracking solid earth cores according to claim 7, wherein said base is a scoop wall in the shape of a half cylinder which extends downward from said top compartment and is substantially continuous with the front face thereof.

9. An apparatus for cracking solid earth cores according to claim 8 further comprising a return means located within said top compartment for returning said ram means to its retracted position.

10. An apparatus for cracking solid earth cores according to claim 9 wherein said return means is a helical compression spring.

11. An apparatus for grabbing and removing earth cores comprising a grabbing means sized to fit a drill groove made by a conventional rotary core drill after said core drill is withdrawn, whereby said grabbing means is screwed into said drill groove, activated to engage said earth core, and hoisted to lift and remove said earth core leaving a core hole.

12. An apparatus for grabbing and removing earth cores according to claim 11 wherein said grabbing means is hydraulically powered.

13. An apparatus for grabbing and removing earth cores according to claim 11, further comprising a Kelley Bar attached to a conventional drilling machine, whereby said grabbing means is detachably secured to the bottom of said Kelley Bar, and whereby said drilling machine is used to screw down and hoist up said grabbing means.

14. An apparatus for grabbing and removing earth cores according to claim 11 wherein said grabbing means comprises a pair of opposed jaws hinged at one end.

15. An apparatus for grabbing and removing earth cores according claim 14 wherein said jaws are shaped in the form of half-cylinders which taper away from said bottom.

16. An apparatus for grabbing and removing earth cores according to claim 14, further comprises one or more double ended hydraulic pistons communicating with said jaws, whereby expansion of said pistons cause said jaws to close around said earth core.

17. An apparatus for grabbing and removing earth cores according to claim 16, further comprising arms extending upward from said jaws above where said jaws are hinged to one another, wherein said pistons are interposed between said arms such that expansion of said pistons push said arms apart and cause said jaws to close.

* * * * *